US012668452B1

(12) United States Patent
Grubbs

(10) Patent No.: US 12,668,452 B1
(45) Date of Patent: Jun. 30, 2026

(54) DETACHABLE REEL DEVICE FOR FISH TAPES AND ASSOCIATED METHOD

(71) Applicant: Merick Grubbs, Fort Worth, TX (US)

(72) Inventor: Merick Grubbs, Fort Worth, TX (US)

( * ) Notice: Subject to any disclaimer, the term of this patent is extended or adjusted under 35 U.S.C. 154(b) by 0 days.

(21) Appl. No.: 19/341,654

(22) Filed: Sep. 26, 2025

(51) Int. Cl.
*B65H 75/40* (2006.01)
*B65H 75/44* (2006.01)

(52) U.S. Cl.
CPC ..... *B65H 75/406* (2013.01); *B65H 75/4457* (2013.01); *B65H 75/4494* (2013.01); *B65H 2402/412* (2013.01); *B65H 2701/376* (2013.01)

(58) Field of Classification Search
CPC ..... B65H 75/406; B65H 75/4457; B65H 75/4494; B65H 2402/412; B65H 2701/376
See application file for complete search history.

(56) References Cited

U.S. PATENT DOCUMENTS

| | | | | |
|---|---|---|---|---|
| 3,549,127 | A | 12/1970 | Niemann | |
| 4,034,962 | A | 7/1977 | Thomsen | |
| 4,484,718 | A | 11/1984 | Jones-Fenleigh | |
| 5,110,092 | A | 5/1992 | Blaha et al. | |
| 5,423,516 | A | 6/1995 | Blaha | |
| 6,016,609 | A | 1/2000 | Donovan et al. | |
| 6,153,791 | A * | 11/2000 | Moore | C07C 51/47 562/513 |
| 6,224,038 | B1 | 5/2001 | Walsten et al. | |
| 7,374,150 | B2 | 5/2008 | Wiesemann et al. | |
| 8,496,229 | B1 * | 7/2013 | Mayhall | B65H 75/4486 254/342 |
| 12,249,816 | B2 | 3/2025 | Miller et al. | |
| 12,275,615 | B2 | 4/2025 | Adams et al. | |
| 2005/0029383 | A1 * | 2/2005 | Wiesemann | B65H 75/406 242/395 |
| 2005/0194488 | A1 * | 9/2005 | Radle | B65H 75/406 242/395 |
| 2007/0272905 | A1 | 11/2007 | Ziebart et al. | |
| 2016/0096705 | A1 | 4/2016 | Ryals | |

* cited by examiner

*Primary Examiner* — Sang K Kim
(74) *Attorney, Agent, or Firm* — Alloy Patent Law

(57) ABSTRACT

A reel device configured for use with a fish tape is provided. The reel device includes a first body part and a second body part that engage to form a frame receivable within a cut-out portion of a fish tape housing. The frame may include side walls, corner portions, extension portions, lips, grooves, projections, and reinforcement ribs that provide structural stability and alignment with the housing. An extension arm projects from the frame and supports a rotational assembly including a knob. The knob is rotatable relative to the frame and coupled through a screw and bearing arrangement, enabling continuous retraction of a fish tape wire into the housing with reduced user effort. The geometry of the frame may be square, polygonal, circular, or curved to conform to different fish tape housings.

17 Claims, 9 Drawing Sheets

DETACHABLE REEL DEVICE FOR FISH TAPES AND ASSOCIATED METHOD

FIELD OF THE INVENTION

The present invention relates generally to hand tools for installing electrical conductors and, more particularly, to a reel device for fish tapes used to route pull lines or wires through walls, ceilings, and conduits.

BACKGROUND

A fish tape is a flexible steel or fiberglass tool used to pull electrical wires through wall cavities, conduits, and tight spaces. It's essential for DIY electrical projects, such as installing outlets, ceiling fans, or light fixtures, because it allows you to route wires behind walls without major demolition work. A conventional fish tape typically consists of a long, semi-rigid steel or fiberglass tape stored within a circular housing having a central opening and a handle portion. During use, a user/electrician pushes the tape outward through the housing opening and guides it through the conduit or wall cavity. Once the pull is completed, the tape must be wound back into the housing for storage and subsequent use. In most conventional models, this retraction is accomplished entirely by hand. The installer grips the tape itself or manipulates the housing in a rocking or twisting motion to feed the tape back into the case manually. This process is slow, repetitive, and physically fatiguing, particularly after long runs of tape or when multiple pulls must be performed during a workday.

To reduce operator effort, some manufacturers have experimented with housings that incorporate built-in reels or crank mechanisms, such as the Multi-Groove Fiberglass Fish Tape by Klein Tools, the Ideal Zoom Stainless Steel Fish Tape, and the VEVOR Fish Tape, among others. These designs typically position a handle or crank directly on the fish tape housing, allowing the user to rotate the crank to reel in the tape. When using the standard housings with an integrated handle, the user/electrician must retract the fish tape by gripping the housing itself (while holding the handle with one hand) and rotating it incrementally, typically releasing and repositioning their grip every 90 degrees of rotation. This stop-and-start motion is inefficient and can lead to increased operator fatigue over time. Second, without a dedicated reeling handle, the user's control during winding is reduced, further slowing retraction. Thus, despite the integration of a handle in the housing of the fish tape, the integration has proven to be insufficient to overcome the issue of repositioning the grip while reeling in the tape inside the housing.

Additionally, besides the fish tapes with integrated handles, there are many commercially available fish tapes, such as Greenlee® Non-Conductive Fish Tape, Blued-Steel™ Fish Tape, and Thumb-Winder™ that are sold without any reeling handle. This is not because users do not desire a handle, but rather because past integrated handle designs have tended to break under jobsite conditions, leading manufacturers to omit them altogether. As a result, the most common fish tapes in use today require electricians to retract the tape manually, without any dedicated crank or handle.

Accordingly, there exists a clear need for a reel device that can be attached to commonly available fish tape housings, enabling continuous rotation and smooth retraction without requiring the user to release and reposition their grip repeatedly.

SUMMARY

According to one implementation of the present disclosure, a reel device for a fish tape is provided. The reel device is designed to facilitate the retraction of a fish tape wire into its housing with reduced effort and improved efficiency. The reel device comprises a first body part and a second body part, both configured to engage with one another to secure the reel device to the fish tape housing. A knob is coupled to at least one of the body parts and is rotatable relative thereto, thereby enabling the user to reel in the fish tape by applying rotational force to the knob. In some embodiments, one of the body parts includes an extension arm that supports the knob through a bearing and screw arrangement, allowing smooth, low-friction rotation. By incorporating this modular reeling mechanism, the device provides greater leverage, reduces operator fatigue, and increases retraction speed compared to conventional manual fish tape housings.

According to another implementation of the present disclosure, a method of retracting a fish tape using a reel device is provided. The method includes providing a reel device comprising a first body part, a second body part, and a knob. The method further includes engaging the first body part with the second body part to secure the reel device to a housing of the fish tape, thereby mounting the device in a stable configuration. Once installed, the method includes rotating the knob relative to at least one of the body parts, wherein the rotation is transmitted through a bearing-supported connection to enable smooth winding of the fish tape. Rotation of the knob causes the fish tape wire to be retracted into the housing in a controlled manner. This method reduces the manual effort otherwise required to pull the tape back into the housing, thereby providing faster retraction speed and lowering operator fatigue compared to conventional fish tape use.

The reel device for the fish tape and the associated method of the present disclosure overcome one or more of the shortcomings of the prior art. Additional features and advantages may be realized through the techniques of the present disclosure. Other embodiments and aspects of the disclosure are described in detail herein and are considered a part of the claimed disclosure.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Unless the context requires otherwise, throughout the specification and claims which follow, the word "comprise" and variations thereof, such as, "comprises" and "comprising" are to be construed in an open, inclusive sense, that is as "including, but not limited to."

As used in this specification and the appended claims, the singular forms "a," "an," and "the" include plural referents unless the content clearly dictates otherwise. It should also be noted that the term "or" is generally employed in its broadest sense, that is as meaning "and/or" unless the content clearly dictates otherwise.

The headings and abstract of the disclosure provided herein are for convenience only and do not interpret the scope or meaning of the implementations.

Figure 1:
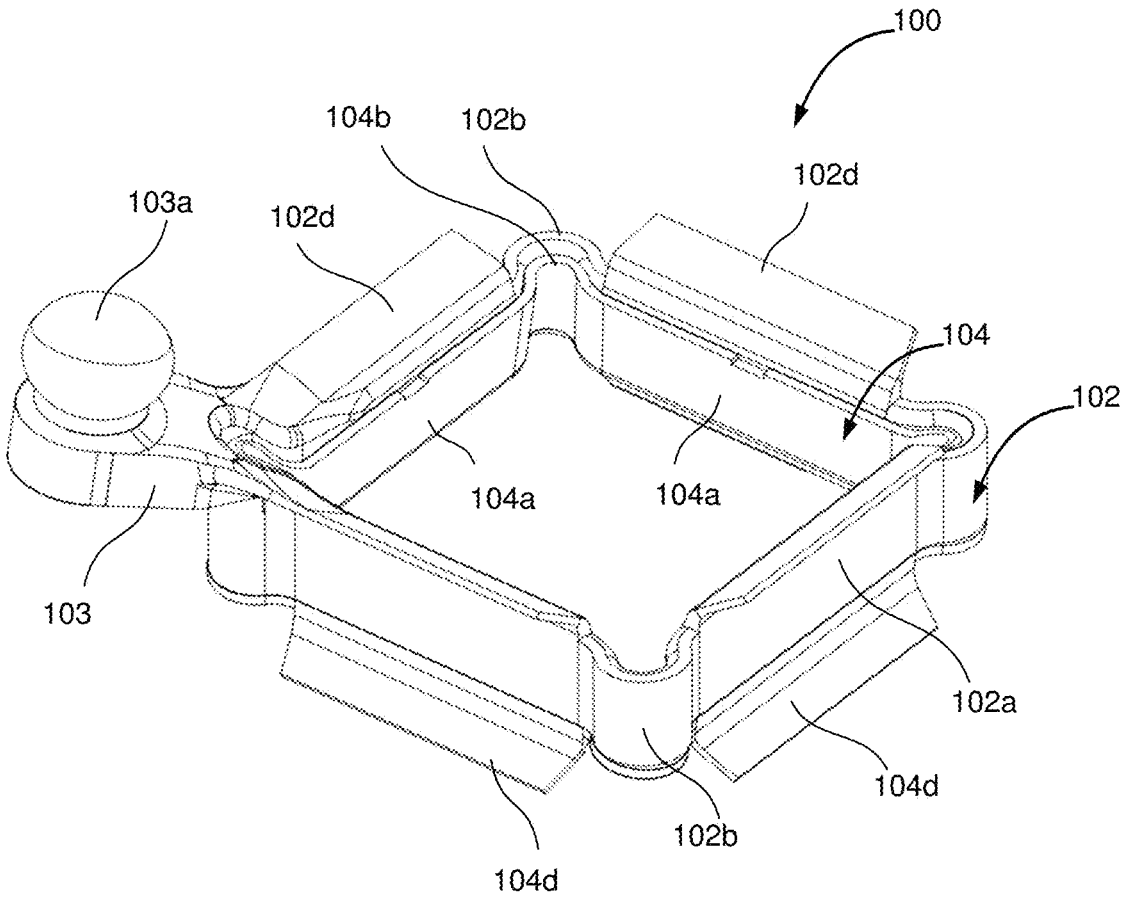
FIG. 1 illustrates a reel device configured to be used with a conventional fish tape, in accordance with an exemplary embodiment of the present disclosure.

FIG. 1 illustrates a reel device 100 in accordance with an exemplary embodiment of the present disclosure. The reel device 100 is configured as a standalone component that can be operatively mounted to a conventional fish tape housing to facilitate retraction of a fish tape wire.

In some embodiments, the reel device 100 comprises a first body part 102 and a second body part 104 (also shown in FIGS. 3A-3B and FIGS. 4A-4B) that engage with each other. The first body part 102 and the second body part 104 together form a frame of the reel device 100. In some embodiments, the first body part 102 and the second body part 104 may be designed to engage with one another in a snap-fit manner. In some other embodiments, the first body part 102 and the second body part 104 may be joined using fasteners, adhesives, or other connecting structures.

In some embodiments, the geometry of the first body part 102 and the second body part 104 may be square, rectangular, circular, or polygonal, and may be adapted to conform to a corresponding cutout portion in a fish tape housing. This adaptability allows the reel device 100 to be produced in different sizes and shapes to match the dimensions of available fish tapes.

In some embodiments, the first body part 102 comprises an extension arm 103 that extends outwards from one of the corners of the first body part 102. The extension arm 103 may act as a mounting platform for a rotational assembly of the reel device 100. In some embodiments, the extension arm 103 is integrally molded with the first body part 102. In other embodiments, the extension arm 103 may be formed separately and secured to the first body part 102 through mechanical fastening. Furthermore, the extension arm 103 is offset from the central axis of the reel device 100, thereby providing increased mechanical leverage when torque is applied. The offset geometry allows the user to generate greater rotational force with less physical effort, reducing strain on the wrist and forearm during prolonged use.

In some embodiments, the first body part 102 further comprises first side walls 102*a* disposed around the perimeter of the first body part 102. The arrangement of the first side walls 102*a* establishes an open central region, which may correspond to the cut-out or opening in a conventional fish tape housing. The number, size, and contour of the first side walls 102*a* may be varied to accommodate different shapes of fish tape housings, thereby making the reel device 100 adaptable across multiple housing designs.

In some embodiments, the first body part 102 further comprises first corner portions 102*b*, which are formed at junctions between first side walls 102*a*. The first corner portions 102*b* are shaped to conform to the geometry of the fish tape housing, enabling the first body part 102 to seat flush against or nest within the housing contours. In some embodiments, the first corner portions 102*b* may be radiused or angular, depending on the design of the fish tape housing. Further, in some embodiments, the first corner portions 102*b* may function as stabilizing surfaces that prevent rotational slippage of the reel device 100 during use.

In some embodiments, the first body part 102 further comprises first extension portions 102*d* that extend outwardly or upwardly from the first side walls 102*a* of the first body part 102*a*. The first extension portions 102*d* may provide structural reinforcement and, in some embodiments, serve as alignment features to ensure a proper fit between the reel device 100 and the housing. In addition, the first extension portions 102*d* may define surfaces that resist torsional forces during operation of a rotatable knob 103*a* positioned within the extension arm 103, thereby improving durability and user control.

In some embodiments, one or more of the first side walls 102*a* include grooves (not shown) that may act as structural interfaces that can receive corresponding projections, fasteners, or edges of the second body part 104 or of the fish tape housing itself.

In some embodiments, the second body part 104 also comprises second side walls 104*a* disposed around the perimeter of the second body part 104. The arrangement of the second side walls 104*a* also establishes an open central region, which may correspond to the cut-out or opening in a conventional fish tape housing. The number, size, and contour of the second side walls 104*a* may be varied to accommodate different shapes of fish tape housings, thereby making the reel device 100 adaptable across multiple housing designs.

In some embodiments, the second body part 104 further comprises second corner portions 104*b*, which are formed at junctions between second side walls 104*a*. The second corner portions 104*b* are shaped to conform to the geometry of the fish tape housing, enabling the second body part 104 to seat flush against or nest within the housing contours. In some embodiments, the second corner portions 104*b* may be radiused or angular, depending on the design of the fish tape housing. Further, in some embodiments, the second corner portions 104*b* may function as stabilizing surfaces that prevent rotational slippage of the reel device 100 during use.

In some embodiments, the second body part 104 further comprises second extension portions 104*d* that extend outwardly or upwardly from the second side walls 104*a*. The second extension portions 104*d* may provide structural reinforcement and, in some embodiments, serve as alignment features for ensuring proper fit between the reel device 100 and the fish tape.

The reel device 100 further comprises the rotational assembly that may be receivable in the extension arm 103 of the reel device 100. The rotational assembly comprises a plurality of components that enable the user to retract a fish tape wire of the fish tape. In some embodiments, the plurality of components comprises a rotatable knob 103*a*, a bearing (not shown), and a screw (not shown). In some embodiments, the rotational assembly serves as a rotational interface for the reel device 100.

The first and second body parts 102, 104 may be manufactured from a durable plastic such as ABS or polycarbonate, chosen for its combination of toughness, impact resistance, and light weight. In alternative embodiments, the first and second body parts 102, 104 may be reinforced with fiberglass or metal inserts for additional strength.

Figure 5:
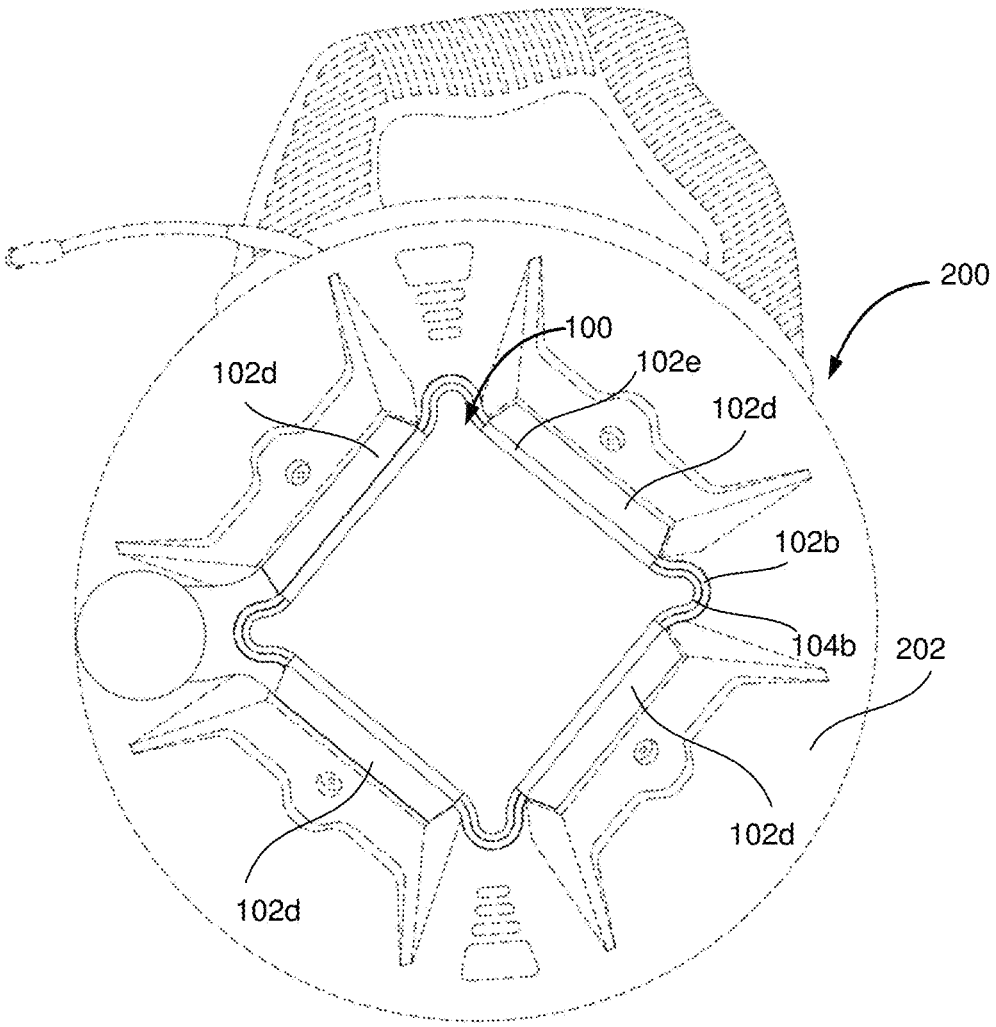
FIGS. 5-6 illustrate a front view and a rear view of the reel device of FIG. 1 installed within a cutout section of the conventional fish tape.
Figure 6:
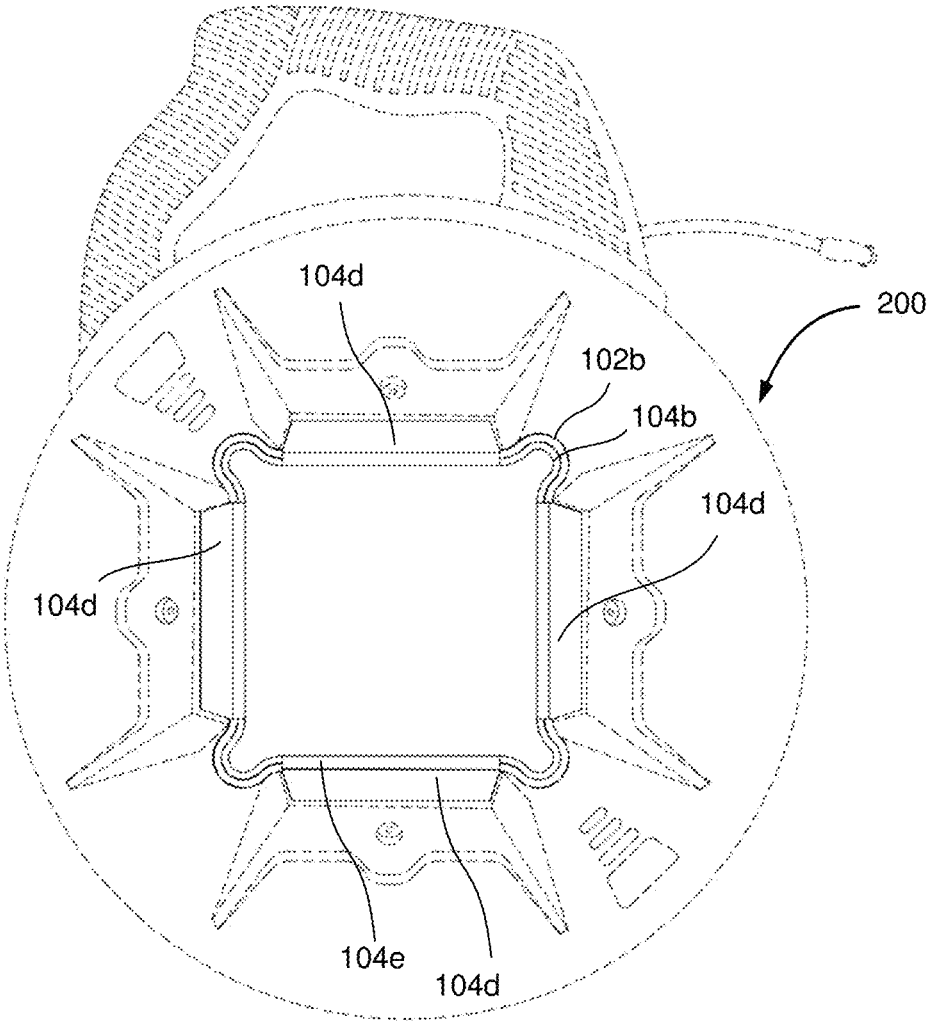

During operation, the first body part 102 and the second body part 104 are assembled together as shown in FIG. 1, thereby enclosing the cutout portion of the fish tape as seen in FIGS. 5-6. Furthermore, when the user rotates the rotatable knob 130*a*, they experience a continuous and fluid rotational motion, as opposed to the stop-and-start action required with conventional fish tapes. This results in faster retraction of the fish tape wire of the fish tape, less physical fatigue, and improved overall efficiency.

Figure 2:
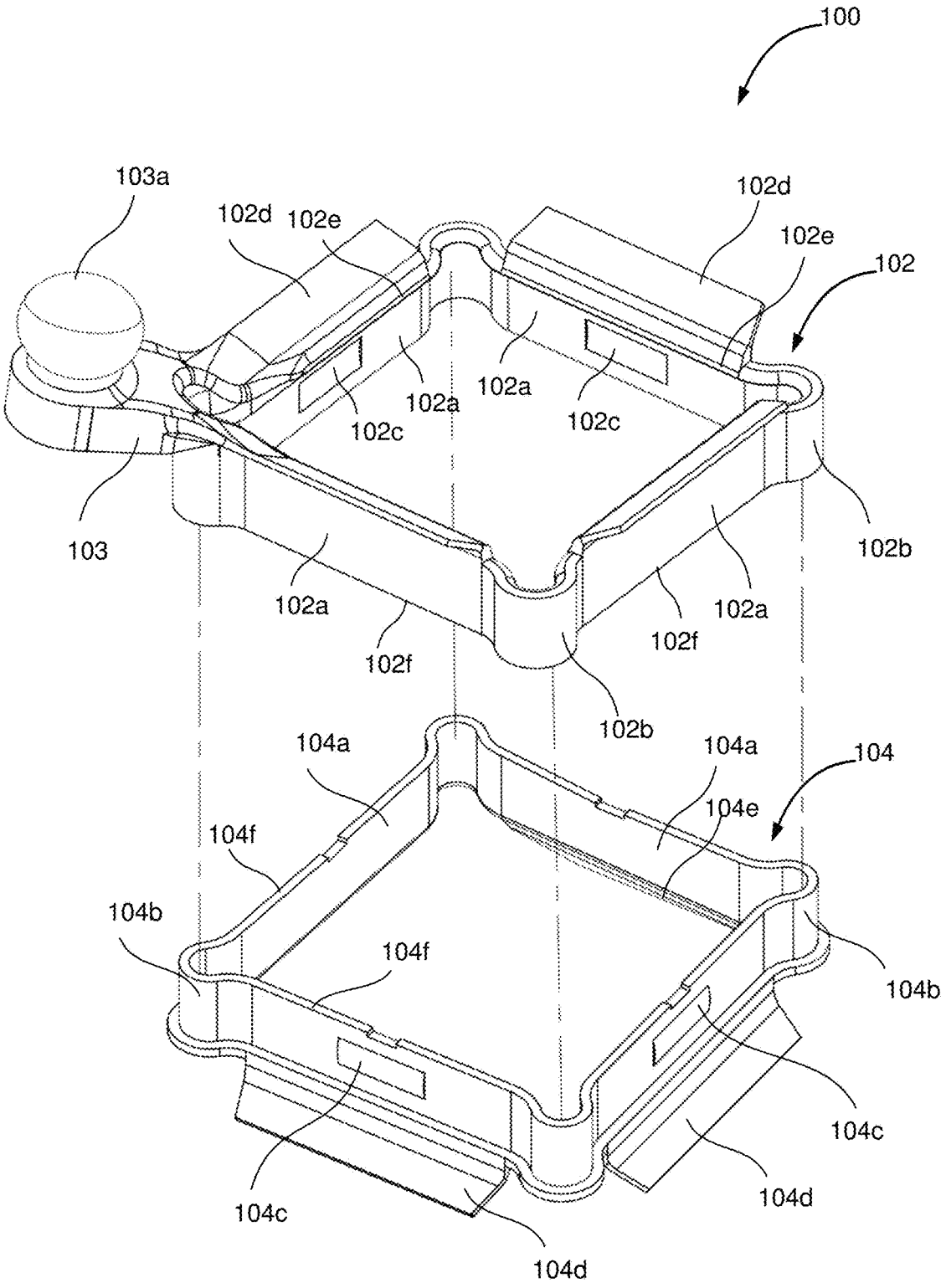
FIG. 2 illustrates an exploded view of the reel device of FIG. 1.

FIG. 2 illustrates an exploded view of the reel device 100 of FIG. 1, in accordance with an exemplary embodiment of the present disclosure. The exploded view illustrates individual components of the reel device 100 and their spatial arrangement prior to assembly, as shown in FIG. 1. Further, the exploded view provides greater clarity regarding the structure and function of the reel device 100.

In the exploded view, the first body part 102 and the second body part 104 are depicted in a separated relation, illustrating how the second body part 104 is configured to slide into or align with the first body part 102. In some embodiments, the engagement between the first body part 102 and the second body part 104 is achieved through a snap-fit mechanism, such as grooves on the first body part 102 that receive complementary projections on the second body part 104. In some other embodiments, the engagement may be accomplished through fasteners, adhesives, or other coupling techniques as described with respect to FIG. 1.

The exploded view, as shown in FIG. 2, illustrates how the extension arm 103 projects away from the first body part 102, providing a platform for mounting the rotational assembly. The offset geometry of the extension arm 103 relative to the central axis of the frame is clearly visible in FIG. 2, highlighting how torque applied through the rotatable knob 103*a* is amplified to reduce user effort during retraction.

The exploded view, as shown in FIG. 2, illustrates some of the additional components of the first body part 102 and the second body part, which are not shown in FIG. 1. As shown in FIG. 2, the first body part 102 further comprises grooves 102*c* that are formed on the first side walls 102*a*. The grooves 102*c* may work as a receiving channel for complementary projections or fasteners associated with the second body part 104, thereby facilitating engagement between the two body parts of the reel device 100. In certain embodiments, the grooves may also serve to reduce material weight, thereby enhancing the flexibility of the first side walls 102*a*.

Furthermore, as shown in FIG. 2, the second body part 104 comprises projections 104*c* formed on the second side walls 104*a*. The projections 104*c* are designed to engage with the grooves 102*c* of the first body part 102 to establish an interlocking fit. This engagement improves assembly by aligning the two body parts and resisting separation under torsional or bending loads. In some embodiments, the projections 104*c* may be formed as tabs, ridges, or dovetail-like structures to enhance retention strength.

Further, as shown in FIG. 2, the first body part 102 also comprises first lips 102*e*. In some embodiments, the first lips 102*e* are disposed of at the ends of the first side walls 102*a*. In some other embodiments, the first lips 102*e* may be joints that are formed between the first side walls 102*a* and the first extension portions 102*d*. Similarly, the second body part 104 comprises second lips 104*e* that may be disposed at the ends of the second side walls 104*a* and/or as joints formed between the second side walls 104*a* and the second extension portions 104*d*.

In some embodiments, the first lips 102*e* and the second lips 104*e* are configured such that when the first body part 102 and the second body part 104 are assembled, the ends of the first side walls 102*a* and the second side walls 104*a* abut against one another along the first and second lips 102*e*, 104*e*. This configuration provides an interlocking interface that enhances the structural rigidity of the reel device 100 and prevents separation of the first and second body parts 102, 104 during use.

In some embodiments, the first and second lips 102*e*, 104*e* may be formed as continuous raised edges extending along the periphery of the side walls. In some other embodiments, the first and second lips 102*e*, 104*e* may be formed as discrete segments positioned at intervals along the first and second side walls 102*a*, 104*a*, thereby reducing material usage while still providing localized abutment and reinforcement. The abutting engagement of the first and second lips 102*e*, 104*e* not only facilitates alignment of the first and second body parts 102, 104 but also provides load distribution along the contacting surfaces.

Further, the first and second lips 102*e*, 104*e* may cooperate with the grooves 102*c* of the first body part 102 and the projections 104*c* of the second body part 104 to achieve a multi-point engagement mechanism. This arrangement enables a snap-fit connection that eliminates the need for external fasteners while allowing disassembly for maintenance or replacement.

In some embodiments, the first body part 102 also comprises first reinforcement ribs 102*f*, positioned along the lower side of the first wall sections 102*a* to increase rigidity and resistance against deformation. The first reinforcement ribs 102*f* may ensure that the geometry of the first body part 102 remains stable during repeated use cycles. The second body part 104 also comprises the second reinforcement ribs 104*f*, positioned along the lower side of the second wall sections 104*a*. The second reinforcement ribs 104*f* may be configured to enhance the stiffness of the second body part 104, prevent deformation of the second side walls 104*a* under stress, and help maintain dimensional stability during repeated winding and unwinding operations.

In some embodiments, the external surface of the rotatable knob 103*a* is contoured for ergonomics. The rotatable knob 103*a* may be rounded with a diameter sized to be comfortably grasped by a user's hand. In some embodiments, the rotatable knob 103*a* includes textured ridges, knurling, or patterned grip surfaces to prevent slippage during rotation. The ergonomic shaping of the rotatable knob 103*a* enables continuous rotation without requiring the user to release and reposition their grip, which is a significant improvement over conventional fish tape housings that must be incrementally rotated by hand. By enabling continuous grip on the rotatable knob 103*a* throughout rotation, the reel device 100 overcomes the stop-and-start limitations of conventional housings, thereby enhancing ergonomics, reducing fatigue, and improving efficiency in fish tape operations.

Although the extension arm 103*a* is illustrated and described as being positioned on the first body part 102, in alternative embodiments, the extension arm 103*a* may instead be formed on the second body part 104, or both the first body part 102 and the second body part 104 may each include an extension arm. In such variations, either a single extension arm or both in combination may provide a mounting platform for the rotational assembly and the knob, thereby allowing flexibility in design and manufacturing while maintaining the functional advantages of offset leverage and continuous retraction of the fish tape wire.

Figure 3A:
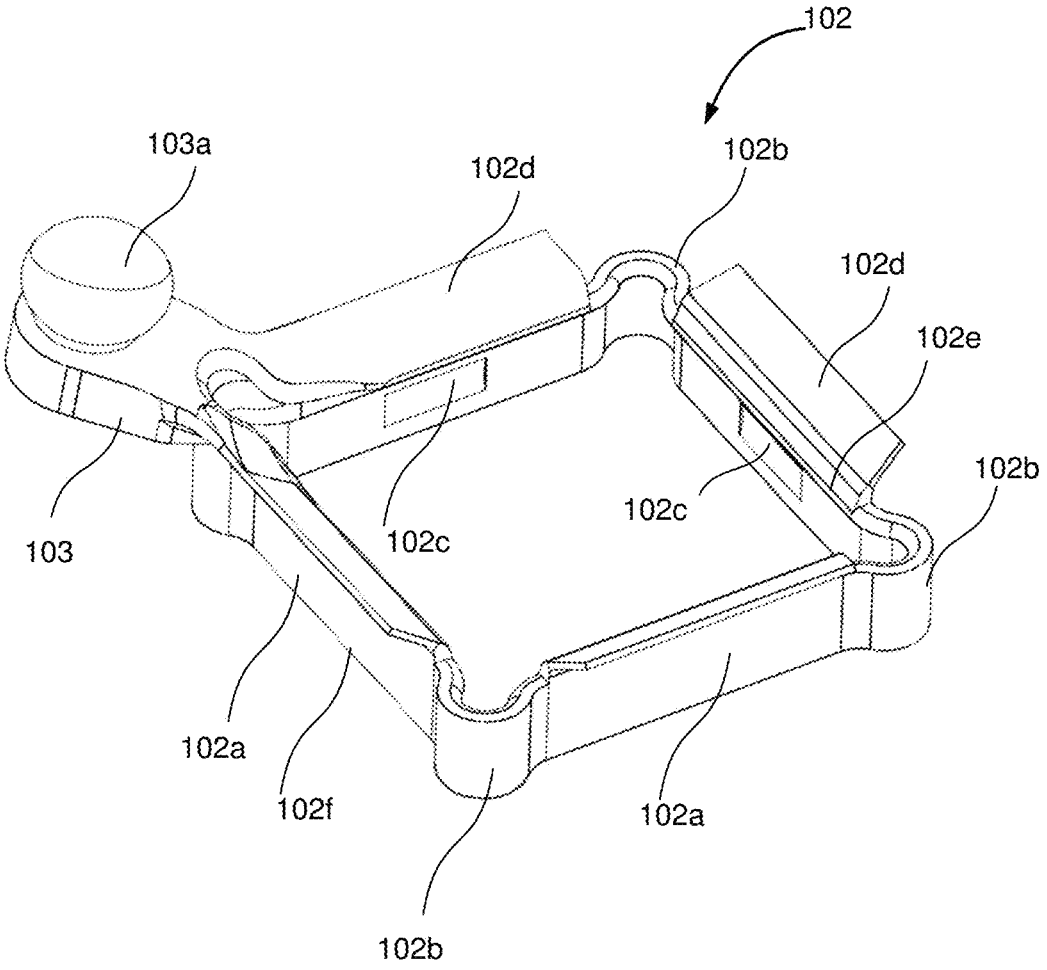
FIG. 3A illustrates a front perspective view of a first portion of a reel device of FIG. 1.

FIG. 3A illustrates a front perspective view of a first body part 102 of the reel device 100 of FIG. 1 in accordance with an exemplary embodiment of the present disclosure.

As shown in FIG. 3A, the first body part 102 comprises the first side walls 102*a* disposed around its perimeter. The first side walls 102*a* define the general outline of the first body part 102 and establish an open central region corresponding to a cut-out portion of a fish tape housing. The configuration of the first side walls 102*a* may be square, rectangular, polygonal, or otherwise adapted to conform to different fish tape housing geometries.

The first body part 102 further comprises the first corner portions 102*b* formed at the junctions between the first side walls 102*a*. The first corner portions 102*b* are contoured to conform to the geometry of the fish tape housing, enabling the first body part 102 to seat flush against or nest within the housing contours. The corner portions 102*b* may be radiused or angular and may also serve as stabilizing surfaces that resist rotational slippage during operation.

The first body part 102 further comprises grooves 102*c* positioned in one or more of the first side walls 102*a*. The grooves 102*c* act as structural receiving interfaces designed to engage with complementary projections 104*c* of the second body part 104. This engagement aligns the first body part 102 with the second body part 104 and resists separation under torsional or bending loads. The first body part 102 additionally comprises the first extension portions 102*d* that extend outwardly from selected regions of the first side walls 102*a*. The first extension portions 102*d* provide structural reinforcement and alignment features, ensuring that the reel device 100 properly mates with a fish tape housing.

The first body part 102 further comprises the first lips 102*e*, which are disposed both at the ends of the first side walls 102*a* and at joints formed between the first side walls 102*a* and the first extension portions 102*d*. The first lips 102*e* provide abutment surfaces that contact corresponding lips 104*e* of the second body part 104, thereby forming an interlocking interface when the two body parts are assembled. In some embodiments, the first body part 102 also comprises the first reinforcement ribs 102*f*, positioned along the lower side of the first wall sections 102*a* to increase rigidity and resistance against deformation. The first reinforcement ribs 102*f* further ensure that the geometry of the first body part 102 remains stable during repeated use cycles.

The first body part 102 further comprises the extension arm 103, which extends outwardly from one corner of the first body part 102. The extension arm 103 acts as the mounting platform for the rotational assembly. The extension arm 103 is offset from the central axis of the reel device 100, thereby providing increased mechanical leverage when torque is applied. Mounted on the extension arm 103 is the rotatable knob 103*a*, which enables continuous and fluid winding of the fish tape wire. In some embodiments, the screw 103*b* may be dimensioned, for example, as an M8 screw, although other sizes may be utilized depending on design strength requirements. In some embodiments, the bearing is a 608RS ball bearing.

Figure 3B:
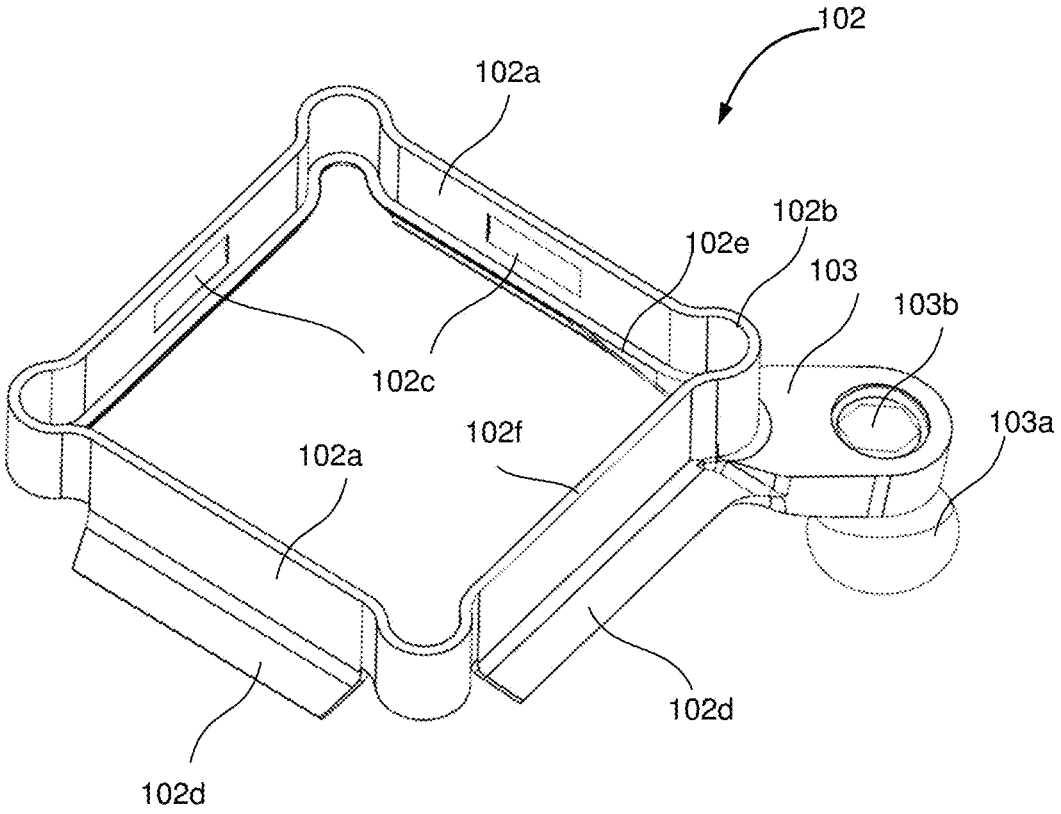
FIG. 3B illustrates a rear perspective view of the first portion of the reel device of FIG. 1.

FIG. 3B illustrates a rear perspective view of the first body part 102 of the reel device 100 of FIG. 1, in accordance with an exemplary embodiment of the present disclosure.

As mentioned with respect to FIGS. 1 to 3A, the first body part 102 comprises the first side walls 102*a*, the first corner portions 102*b*, the grooves 102*c*, the extension portions 102*d*, the first lips 102*e*, and the first reinforcement ribs 102*f*.

Further, as shown in FIG. 3B, the first body part 102 comprises the extension arm 103, which serves as the mounting platform for the rotational assembly and is offset from the central axis of the device to provide leverage for the user. Disposed on the extension arm 103 is the rotatable knob 103*a*, which allows the user to apply continuous rotational motion to retract fish tape wire.

In some embodiments, the rotational assembly comprises the plurality of components arranged in sequence. The rotational assembly comprises the rotatable knob 103*a*, the screw 103*b*, and the bearing (not shown). In some embodiments, the bearing is configured to be press-fit in the extension arm 103, or received into a bore of the extension arm 103, or retained within a recess of the extension arm 103. The screw 103*b* passes through the inner race of the bearing and extends outwardly from a bottom portion for engagement with the rotatable knob 103*a*. In some embodiments, the rotatable knob 103*a* is coupled to the screw 103*b*, either by means of an embedded nut positioned within the rotatable knob 103*a* or by integral threading formed directly in a structure of the rotatable knob 103*a*. In some embodiments, the rotatable knob 103*a* includes a cavity sized to retain a metal nut, which provides a strong threaded interface for engaging the screw 103*b*. In some other embodiments, the rotatable knob 103*a* may be formed with molded-in threads that directly engage the screw 103*b*. In both cases, the rotatable knob 103*a* is secured to the screw 103*b* and is freely rotatable relative to the frame of the reel device 100 due to the presence of the bearing. In some embodiments, the embedded nut may be an M8 nut.

Figure 4A:
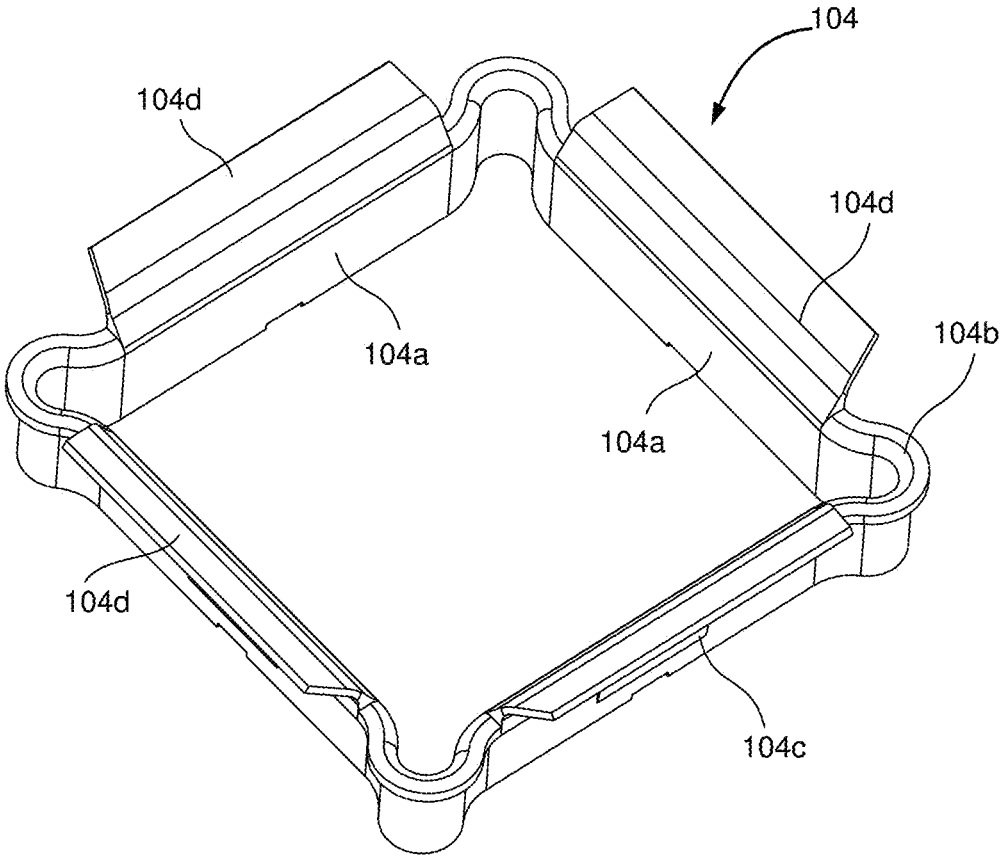
FIG. 4A illustrates a front perspective view of a second portion of the reel device of FIG. 1.
Figure 4B:
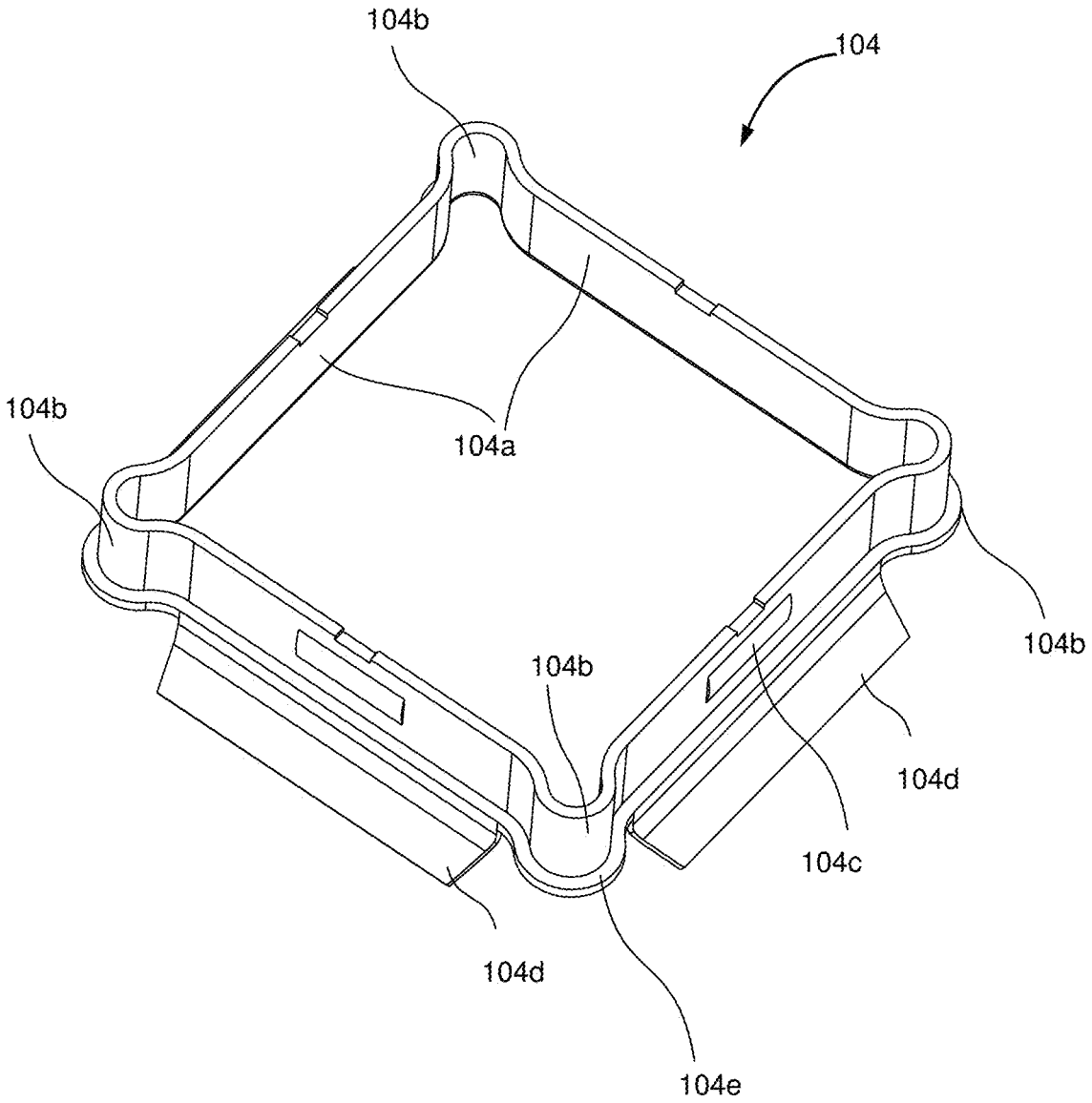
FIG. 4B illustrates a rear perspective view of the second portion of the reel device of FIG. 1.

FIGS. 4A and 4B illustrate front and rear perspective views of a second body part 104 of the reel device 100 of FIG. 1, in accordance with an exemplary embodiment of the present disclosure. FIGS. 4A and 4B collectively illustrate the detailed structure of the second body part 104.

The second body part 104 comprises the second side walls 104*a* disposed around its perimeter. The arrangement of the second side walls 104*a* defines the general outline of the second body part 104 and establishes an open central region corresponding to the cut-out portion of the fish tape housing. The number, shape, and contour of the second side walls 104*a* may vary depending on the geometry of the housing to which the reel device 100 is mounted. The second body part 104 also comprises the second corner portions 104*b*, which are formed at the junctions between adjacent second side walls 104*a*. The second corner portions 104*b* are shaped to conform to the geometry of the fish tape housing, thereby enabling the second body part 104 to seat flush against the housing contours. In some embodiments, the second corner portions 104*b* may be radiused or angular. The corner portions 104*b* may also serve as stabilizing features that resist rotational slippage and help maintain alignment during operation of the reel device 100.

The second body part 104 further comprises the projections 104*c* that are positioned in the second side walls 104*a*. These projections 104*c* are configured to engage with the complementary grooves 102*c* of the first body part 102, thereby forming an interlocking connection between the first and second body parts 102, 104. The second body part 104 additionally comprises the second extension portions 104*d* that extend outwardly from the second side walls 104*a*. The extension portions 104*d* provide structural reinforcement and alignment during assembly and cooperate with the corresponding the first extension portions 102*d* of the first body part 102 to resist torsional deformation generated during the operation of the rotatable knob 103*a*.

The second body part 104 further comprises the second lips 104*e*. The second lips 104*e* are disposed both at the ends of the second side walls 104*a* and at joints formed between the second side walls 104*a* and the second extension portions 104*d*. When the second body part 104 is assembled with the first body part 102, the second lips 104*e* abut against the corresponding first lips 102*e*, thereby forming an abutment interface. This interface increases structural rigidity, distributes loads across the contacting surfaces, and prevents separation of the assembled body parts during use. The second body part 104 also comprises the second reinforcement ribs 104*f*, positioned along the lower side of the second side walls 104*a*. The second reinforcement ribs 104*f* are configured to enhance the stiffness of the second body part 104, prevent deformation of the second side walls 104*a* under stress, and help maintain dimensional stability during repeated winding and unwinding operations.

FIG. 5 illustrates a front view of the reel device 100 mounted within a fish tape 200, in accordance with an exemplary embodiment of the present disclosure.

As shown in FIG. 5, the reel device 100 is positioned within a cutout section of the fish tape 200. Further, as shown, the first body part 102 includes the first extension portions 102*d* that extend outwardly from the first side walls 102*a* and contact the internal surface of the fish tape 200). The extension portions 102*d* provide stability, alignment, and load distribution, ensuring that the reel device 100 remains centered and does not shift during use.

The first corner portions 102*b* of the first body part 102 are shaped to conform to the internal geometry of the housing 202, thereby enabling the first body part 102 to seat flush against the housing contours of the fish tape 200. In addition, the second corner portions 104*b* of the second body part 104 are visible from the front view, illustrating how the first and second body parts 102, 104 interconnect while installed inside the fish tape 200. Further, as shown in FIG. 5, the first lips 102*e* engage with the second lips 104*e* (not shown), and the ends of the first side walls 102*a* and the second side walls 104*a* abut against one another along the first and second lips 102*e*, 104*e*. This abutting engagement secures the first body part 102 and the second body part 104 together, preventing relative movement between them during operation.

FIG. 6 illustrates a rear view of the reel device 100 mounted within the fish tape 200, in accordance with an exemplary embodiment of the present disclosure.

As shown in FIG. 6, the second body part 104 is positioned to face the rear side of the fish tape 200. The second body part 104 comprises the second extension portions 104*d* that extend outwardly from the second side walls 104*a* and engage with the internal surfaces of the fish tape 200. These extension portions 104*d* ensure secure positioning and reinforcement, preventing wobbling or disengagement during continuous rotation of the rotatable knob 103*a*.

Furthermore, as illustrated in FIG. 6, the second corner portions 104*b* of the second body part 104 are positioned at the junctions of the second side walls 104*a* and are shaped to match the interior geometry of the fish tape 200. This configuration enhances structural conformity and stability, enabling efficient torque transfer during reel operation. Further, as shown in FIG. 6, the second lips 104*e* engage with the first lips 102*e* (not shown), and the ends of the first side walls 102*a* and the second side walls 104*a* abut against one another along the first and second lips 102*e*, 104*e*. Thus, FIGS. 5 and 6 collectively demonstrate how the first body part 102 and the second body part 104 of the reel device 100 integrate with one another and with the housing 202 of the fish tape 200. In FIGS. 5-6, the housing 202 of the conventional fish tape 200 is shown in broken lines merely for representation purposes. The proposed reel device is capable of being custom-made in various other shapes/structures to fit any conventional or non-conventional fish tape, as shown in FIGS. 7A-7D.

FIGS. 7A-7D illustrate alternative embodiments of a reel device configured to conform to different fish tape housing geometries, in accordance with exemplary embodiments of the present disclosure.

While each embodiment may differ in outline, all reel devices retain the fundamental features described with respect to reel device 100, including side walls, corner portions, extension portions, lips, grooves, and projections, which collectively provide alignment, structural reinforcement, and interlocking assembly.

In each of FIGS. 7A-7D, the dotted lines represent the inner surface of a conventional fish tape housing, while the solid lines represent the reel device seated within the housing.

Figure 7A:
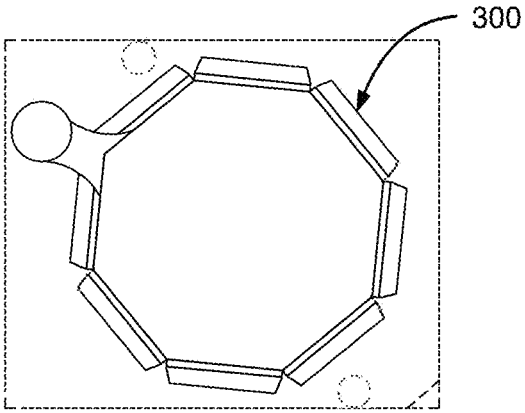
FIGS. 7A-7D illustrate the reel device of the present invention customized based on the size and shapes of the cut-out section of the conventional fish tapes.

As shown in FIG. 7A, a reel device 300 may be formed with a generally octagonal geometry. This embodiment comprises eight side walls joined by corresponding corner portions, enabling the reel device 300 to seat within housings featuring polygonal or multi-faceted cut-outs. Extension portions extend outwardly to engage the housing surface, and lips disposed at the wall ends and wall-extension joints provide abutment surfaces that secure the assembly.

Figure 7B:
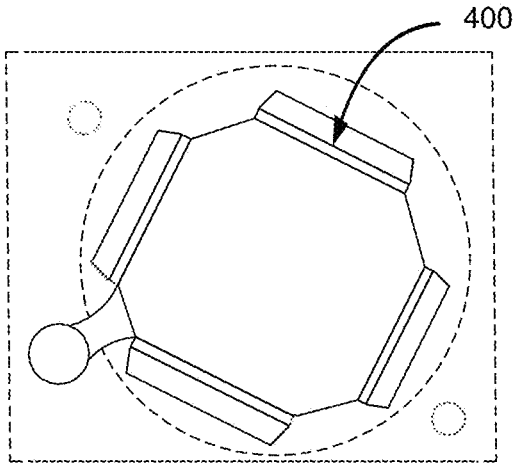

Further, as shown in FIG. 7B, a reel device 400 is shown with a hybrid circular-polygonal geometry, where flat wall sections alternate with angled corners to create a profile suitable for housings that are neither strictly circular nor polygonal. Here, the corner portions are shaped to align with angled housing sections, while the extension portions extend outward to meet the circular boundary, ensuring centering and stability.

Figure 7C:
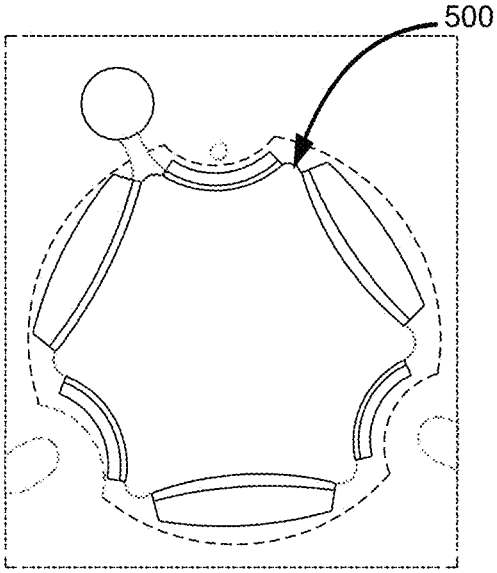

Further, as shown in FIG. 7C, a reel device 500 having a rounded triangular or curved polygonal profile is illustrated. The side walls in this embodiment are arcuate, and the corner portions are smoothly radiused, enabling the reel device 500 to seat within housings having rounded triangular or curved interior contours. Extension portions may also be curved to follow the arcuate profile of the housing, while lips provide abutment surfaces at both the wall ends and wall-extension junctions.

Figure 7D:
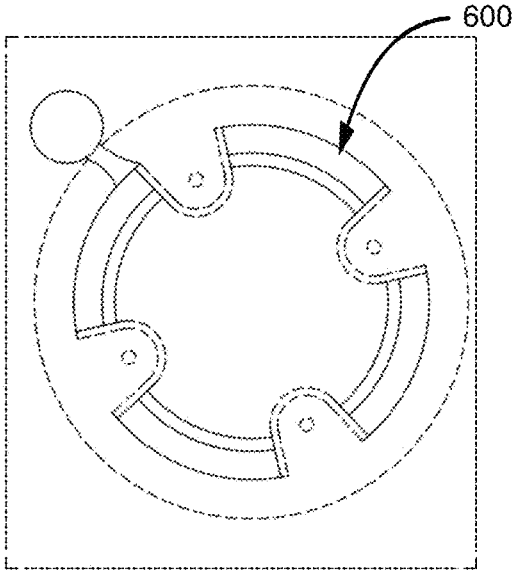

Further, as shown in FIG. 7D, a reel device 600 with a fully circular geometry, designed to closely match housings with circular cut-outs, is illustrated. The reel device 600 may include extension portions for added reinforcement, lips for abutment, and grooves and projections for interlocking assembly, ensuring that the two body parts are securely held together.

Across all embodiments shown in FIGS. 7A-7D, the reel device demonstrates the ability to adapt to the geometry of different fish tape housings while maintaining the same core structural and functional principles. The polygonal, hybrid, curved, or circular outlines ensure compatibility with various housing designs, while extension portions, lips, grooves, and projections provide multi-point alignment and reinforcement. Regardless of geometry, the reel device continues to support an offset extension arm and rotatable knob, thereby enabling smooth, ergonomic, and continuous retraction of fish tape wire. Thus, FIGS. 7A-7D collectively illustrate that the reel device of the present disclosure is not limited to a square configuration but may be implemented in multiple alternative shapes to conform to the cut-out portion of a corresponding fish tape housing, without departing from the inventive concept.

The above description of shown example implementations, including what is described in the Abstract, is not intended to be exhaustive or to limit the implementations to the precise forms disclosed. Although specific implementations of and examples are described herein for illustrative purposes, various equivalent modifications can be made without departing from the spirit and scope of the disclosure, as will be recognized by those skilled in the relevant art. Moreover, the various example implementations described herein may be combined to provide further implementations.

What is claimed is:

1. A reel device, comprising:

a first body part, wherein the first body part comprises: first side walls, first corner portions formed at junctions between the first side walls, first extension portions extending outwardly from the first side walls, grooves disposed on at least one of the first side walls, and first lips disposed at ends of the first side walls and at joints between the first side walls and the first extension portions;

a second body part configured to engage with the first body part to form a frame receivable within a cut-out portion of a fish tape, wherein the second body part comprises second side walls, second corner portions formed at junctions between the second side walls, second extension portions extending outwardly from the second side walls, projections disposed on at least one of the second side walls, and second lips disposed at ends of the second side walls and at joints between the second side walls and the second extension portions; and a rotational assembly including a knob coupled to at least one of the first body part and the second body part, the knob being rotatable relative to the frame to retract a fish tape wire into the fish tape.

2. The reel device of claim 1, wherein at least one of the first body part and the second body part comprises an extension arm, wherein the extension arm is offset from a central axis of the frame, and wherein the extension arm is configured to receive the rotational assembly.

3. The reel device of claim 2, wherein the rotational assembly further includes a bearing disposed within the extension arm, and wherein the bearing supports free rotation of the knob.

4. The reel device of claim 3, wherein the knob is coupled to a screw extending upwardly from a bottom portion of the frame through the bearing, the screw being retained by at least one of threading formed in the knob and a nut embedded within the knob.

5. The reel device of claim 2, wherein the extension arm is molded with at least one of the first body part and the second body part.

6. The reel device of claim 2, wherein the extension arm is fastened to at least one of the first body part and the second body part.

7. The reel device of claim 1, wherein to engage the second body part with the first body part, the first body part and the second body part are configured to interlock with one another through engagement of the grooves and the projections, and abutment of the first lips and the second lips.

8. The reel device of claim 1, wherein the first body part and the second body part are configured to engage through a snap-fit engagement of the grooves and the projections.

9. The reel device of claim 8, wherein a location of the grooves on the first body part aligns with a location of the projections on the second body part for the snap-fit engagement.

10. The reel device of claim 1, wherein the first body part further comprises first reinforcement ribs disposed along the first side walls, and the second body part further comprises second reinforcement ribs disposed along the second side walls.

11. The reel device of claim 1, wherein a geometry and a size of the first body part and the second body part are based on dimensions and a shape of the fish tape, and wherein the geometry is selected from a group comprising: square, rectangular, polygonal, circular, hybrid circular-polygonal, and curved polygonal geometries based on the cut-out portion of the fish tape.

12. The reel device of claim 1, wherein an external surface of the rotatable knob is contoured for ergonomics and includes textured ridges, knurling, or grip features.

13. The reel device of claim 1, wherein the first and second corner portions are contoured to conform to the geometry of the fish tape.

14. The reel device of claim 1, wherein the first body part and the second body part are configured to engage using at least one of fasteners, adhesives, and coupling structures.

15. A fish tape assembly, comprising:

a fish tape comprising at least a housing with a cut-out portion; and a reel device comprising:

a first body part, wherein the first body part comprises: first side walls, first corner portions formed at junctions between the first side walls, first extension portions extending outwardly from the first side walls, grooves disposed on at least one of the first side walls, and first lips disposed at ends of the first side walls and at joints between the first side walls and the first extension portions;

a second body part configured to engage with the first body part to form a frame receivable within the cut-out portion of the fish tape, wherein the second body part comprises second side walls, second corner portions formed at junctions between the second side walls, second extension portions extending outwardly from the second side walls, projections disposed on at least one of the second side walls, and second lips disposed at ends of the second side walls and at joints between the second side walls and the second extension portions; and a rotational assembly including a knob coupled to at least one of the first body part and the second body part, wherein the knob is rotatable relative to the frame to retract a fish tape wire into the housing of the fish tape.

16. A method of retracting a fish tape, comprising:

providing a reel device comprising a first body part, a second body part, and a knob;

engaging the first body part with the second body part to form a frame receivable within a cut-out portion of the fish tape;

rotating a knob of the reel device relative to the frame to retract a fish tape wire into the fish tape, and wherein the first body part comprises:

first side walls, first corner portions formed at junctions between the first side walls, first extension portions extending outwardly from the first side walls, grooves disposed on at least one of the first side walls, and first lips disposed at ends of the first side walls and at joints between the first side walls and the first extension portions, and wherein the second body part comprises:

second side walls, second corner portions formed at junctions between the second side walls, second extension portions extending outwardly from the second side walls, projections disposed on at least one of the second side walls, and second lips disposed at ends of the second side walls and at joints between the second side walls and the second extension portions.

17. The method of claim 16, further comprising providing an extension arm on at least one of the first body part and the second body part, wherein the extension arm is offset from a central axis of the frame.

* * * * *